US006957698B2

(12) United States Patent
Krueger et al.

(10) Patent No.: US 6,957,698 B2
(45) Date of Patent: Oct. 25, 2005

(54) DOWNHOLE ACTIVATABLE ANNULAR SEAL ASSEMBLY

(75) Inventors: Volker Krueger, Celle (DE); Harald Grimmer, Lachendorf (DE); Sven Krueger, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 72 days.

(21) Appl. No.: 10/601,742

(22) Filed: Jun. 23, 2003

(65) Prior Publication Data

US 2004/0069504 A1 Apr. 15, 2004

Related U.S. Application Data

(63) Continuation-in-part of application No. 10/251,138, filed on Sep. 20, 2002, now abandoned.

(51) Int. Cl.[7] ..... E21B 33/127
(52) U.S. Cl. ..... 166/116; 166/118; 166/122
(58) Field of Search ..... 166/114–116, 118, 166/179, 122, 121, 129, 142, 186, 187, 195, 166/202

(56) References Cited

U.S. PATENT DOCUMENTS

| | | | | |
|---|---|---|---|---|
| 2,812,723 A | | 11/1957 | Coberly | |
| 2,946,565 A | | 7/1960 | Williams | |
| 3,595,075 A | | 7/1971 | Dower | |
| 3,603,409 A | | 9/1971 | Watkins | |
| 3,677,353 A | | 7/1972 | Baker | |
| 3,815,673 A | | 6/1974 | Bruce et al. | |
| 3,850,240 A | * | 11/1974 | Conover | 166/162 |
| 3,908,769 A | * | 9/1975 | Schuyf et al. | 175/48 |
| 3,958,651 A | | 5/1976 | Young | |
| 4,022,285 A | | 5/1977 | Frank | |
| 4,049,066 A | | 9/1977 | Richey | |
| 4,063,602 A | | 12/1977 | Howell et al. | |
| 4,091,881 A | | 5/1978 | Maus | |
| 4,099,583 A | | 7/1978 | Maus | |

(Continued)

FOREIGN PATENT DOCUMENTS

EP 0290250 9/1988

(Continued)

OTHER PUBLICATIONS

*Continuous Circulation Drilling*, L. J. Ayling, Maris Int'l Ltd.; J. W. Jenner, Maris Int'l Ltd., H. Elkins, Varco Drilling Dquipment, this paper prepared for presentation at the 2002 Offshore Technology Confrence, Houston, Texas May 6-9, 2002.

(Continued)

*Primary Examiner*—Frank S. Tsay
(74) *Attorney, Agent, or Firm*—Madan, Mossman & Sriram P.C.

(57) ABSTRACT

Devices and methods are described for establishing an effective annular seal about between an active pressure differential device and a surrounding wellbore sidewall. In other aspects, the invention provides a means of selectively activating such a seal during drilling operations or other operations wherein drilling mud is flowed through the drill string and returns through the annulus. The annular seal assembly may include an inflatable packer element and a hydraulic inflation system. The hydraulic inflation system uses the fluid pressure provided by drilling mud that is returning to the surface via the annulus to inflate the packer element and set the seal. The hydraulic inflation system also buffers and regulates the fluid pressure setting the packer element to avoid overinflation of the element. In other aspects, the seal assembly may comprise a set of mud cups that are set against the borehole sidewall using a pressure differential across the seal assembly or a spring-biased seal element.

28 Claims, 12 Drawing Sheets

U.S. PATENT DOCUMENTS

| | | | | |
|---|---|---|---|---|
| 4,108,257 | A | 8/1978 | Sizer | |
| 4,134,461 | A | 1/1979 | Blomsma | |
| 4,137,975 | A | 2/1979 | Pennock | |
| 4,149,603 | A | 4/1979 | Arnold | |
| 4,210,208 | A | 7/1980 | Shanks | |
| 4,223,747 | A | 9/1980 | Marais | |
| 4,240,513 | A | 12/1980 | Castel et al. | |
| 4,291,772 | A | 9/1981 | Beynet | |
| 4,368,787 | A | 1/1983 | Messenger | |
| 4,436,166 | A | 3/1984 | Hayatdavoudi et al. | |
| 4,440,239 | A | 4/1984 | Evans | |
| 4,534,426 | A | 8/1985 | Hooper | |
| 4,588,035 | A * | 5/1986 | Van Gils et al. | 175/48 |
| 4,613,003 | A | 9/1986 | Ruhle | |
| 4,630,691 | A | 12/1986 | Hooper | |
| 4,744,426 | A | 5/1988 | Reed | |
| 4,813,495 | A | 3/1989 | Leach | |
| 5,150,757 | A | 9/1992 | Nunley | |
| 5,168,932 | A | 12/1992 | Worrall et al. | |
| 5,191,939 | A * | 3/1993 | Stokley | 166/379 |
| 5,355,967 | A | 10/1994 | Mueller et al. | |
| 5,651,420 | A | 7/1997 | Tibbitts et al. | |
| 5,775,443 | A | 7/1998 | Lott | |
| 6,142,236 | A | 11/2000 | Brammer et al. | |
| 6,216,799 | B1 | 4/2001 | Gonzalez | |
| 6,276,455 | B1 | 8/2001 | Gonzalez | |
| 6,374,925 | B1 | 4/2002 | Elkins et al. | 175/25 |
| 6,415,877 | B1 | 7/2002 | Fincher et al. | |
| 6,527,513 | B1 | 3/2003 | Van Drentham-Susman et al. | 415/202 |
| 6,719,071 | B1 | 4/2004 | Moyes | 175/65 |
| 6,758,276 | B2 * | 7/2004 | Reynolds | 166/312 |
| 2003/0146001 | A1 | 8/2003 | Hosie et al. | |

FOREIGN PATENT DOCUMENTS

| | | |
|---|---|---|
| EP | 0 566 290 | 10/1993 |
| WO | WO 00/50731 | 8/2000 |
| WO | WO 02/14649 | 2/2002 |
| WO | WO 03/023182 A1 | 3/2003 |

OTHER PUBLICATIONS

*New Tool Addresses ECD Problem*, William Furlow, Offshore, pp. 88, 89, Jun. 2002.

*Technologies Manage Well Pressures*, Don M. Hannegan, Ron Divine, The American Oil & Gas Reporter, Sep., 2001.

* cited by examiner

DOWNHOLE ACTIVATABLE ANNULAR SEAL ASSEMBLY

CROSS-REFERENCE TO RELATED APPLICATIONS

This application is a continuation-in-part to U.S. patent application Ser. No. 10/251,138 filed on Sep. 20, 2002 and entitled "Active Controlled Bottomhole Pressure System and Method."

BACKGROUND OF THE INVENTION

1. Field of the Invention

This invention relates generally to oilfield wellbore drilling systems and more particularly to drilling systems that utilize active control of bottomhole pressure or equivalent circulating density during drilling of the wellbores. In particular aspects, the invention relates to devices and methods for establishing an effective annular seal across an active pressure differential (APD) device.

2. Background of the Related Art

Oilfield wellbores are drilled by rotating a drill bit conveyed into the wellbore by a drill string. The drill string includes a drill pipe (tubing) that has at its bottom end a drilling assembly (also referred to as the "bottomhole assembly" or "BHA") that carries the drill bit for drilling the wellbore. The drill pipe is made of jointed pipes. Alternatively, coiled tubing may be utilized to carry the drilling of assembly. The drilling assembly usually includes a drilling motor or a "mud motor" that rotates the drill bit. The drilling assembly also includes a variety of sensors for taking measurements of a variety of drilling, formation and BHA parameters. A suitable drilling fluid (commonly referred to as the "mud") is supplied or pumped under pressure from a source at the surface down the tubing. The drilling fluid drives the mud motor and then discharges at the bottom of the drill bit. The drilling fluid returns uphole via the annulus between the drill string and the wellbore inside and carries with it pieces of formation (commonly referred to as the "cuttings") cut or produced by the drill bit in drilling the wellbore.

For drilling wellbores under water (referred to in the industry as "offshore" or "subsea" drilling) tubing is provided at a work station (located on a vessel or platform). One or more tubing injectors or rigs are used to move the tubing into and out of the wellbore. In riser-type drilling, a riser, which is formed by joining sections of casing or pipe, is deployed between the drilling vessel and the wellhead equipment at the sea bottom and is utilized to guide the tubing to the wellhead. The riser also serves as a conduit for fluid returning from the wellhead to the sea surface.

During drilling, the drilling operator attempts to carefully control the fluid density at the surface so as to control pressure in the wellbore, including the bottomhole pressure. Typically, the operator maintains the hydrostatic pressure of the drilling fluid in the wellbore above the formation or pore pressure to avoid well blow-out. The density of the drilling fluid and the fluid flow rate largely determines the effectiveness of the drilling fluid to carry the cuttings to the surface. One important downhole parameter controlled during drilling is the bottomhole pressure, which in turn controls the equivalent circulating density ("ECD") of the fluid at the wellbore bottom.

This term, ECD, describes the condition that exists when the drilling mud in the well is circulated. The friction pressure caused by the fluid circulating through the open hole and the casing(s) on its way back to the surface, causes an increase in the pressure profile along this path that is different from the pressure profile when the well is in a static condition (i.e., not circulating). In addition to the increase in pressure while circulating, there is an additional increase in pressure while drilling due to the introduction of drill solids into the fluid. This negative effect of the increase in pressure along the annulus of the well is an increase of the pressure which can fracture the formation at the shoe of the last casing. This can reduce the amount of hole that can be drilled before having to set an additional casing. In addition, the rate of circulation that can be achieved is also limited. Also, due to this circulating pressure increase, the ability to clean the hole is severely restricted. This condition is exacerbated when drilling an offshore well. In offshore wells, the difference between the fracture pressures in the shallow sections of the well and the pore pressures of the deeper sections is considerably smaller compared to on shore wellbores. This is due to the seawater gradient versus the gradient that would exist if there were soil overburden for the same depth.

In some drilling applications, it is desired to drill the wellbore at at-balance condition or at under-balanced condition. The term at-balance means that the pressure in the wellbore is maintained at or near the formation pressure. The under-balanced condition means that the wellbore pressure is below the formation pressure. These two conditions are desirable because the drilling fluid under such conditions does not penetrate into the formation, thereby leaving the formation virgin for performing formation evaluation tests and measurements. In order to be able to drill a well to a total wellbore depth at the bottomhole, ECD must be reduced or controlled. In subsea wells, one approach is to use a mud filled riser to form a subsea fluid circulation system utilizing the tubing, BHA, the annulus between the tubing and the wellbore and the mud filled riser, and then inject gas (or some other low density liquid) in the primary drilling fluid (typically in the annulus adjacent the BHA) to reduce the density of fluid downstream (i.e., in the remainder of the fluid circulation system). This so-called "dual density" approach is often referred to as drilling with compressible fluids.

Another method for changing the density gradient in a deepwater return fluid path has been proposed, but not used in practical application. This approach proposes to use a tank, such as an elastic bag, at the sea floor for receiving return fluid from the wellbore annulus and holding it at the hydrostatic pressure of the water at the sea floor. Independent of the flow in the annulus, a separate return line connected to the sea floor storage tank and a subsea lifting pump delivers the return fluid to the surface. Although this technique (which is referred to as "dual gradient" drilling) would use a single fluid, it would also require a discontinuity in the hydraulic gradient line between the sea floor storage tank and the subsea lifting pump. This requires close monitoring and control of the pressure at the subsea storage tank, subsea hydrostatic water pressure, subsea lifting pump operation and the surface pump delivering drilling fluids under pressure into the tubing for flow downhole. The level of complexity of the required subsea instrumentation and controls as well as the difficulty of deployment of the system has delayed (if not altogether prevented) the practical application of the "dual gradient" system.

Another approach is described in U.S. patent application Ser. No. 09/353,275, filed on Jul. 14, 1999 and assigned to the assignee of the present application. The U.S. patent application Ser. No. 09/353,275 is incorporated herein by reference in its entirety. One embodiment of this application describes a riserless system wherein a centrifugal pump in a separate return line controls the fluid flow to the surface and thus the equivalent circulating density.

U.S. patent application Ser. No. 10/251,138, which is owned by the assignee of the present invention, and incorporated herein by reference, describes another system for ECD control. In this system, the bottomhole pressure and hence the equivalent circulating density is controlled by creating a pressure differential at a selected location in the return fluid path with an active pressure differential (APD) device to reduce or control the bottomhole pressure. This system is relatively easy to incorporate in new and existing systems. Such drilling systems typically include a rig that moves an umbilical (e.g., drill string) into and out of the wellbore. A bottomhole assembly, carrying the drill bit, is attached to the bottom end of the drill string. A well control assembly or equipment on the well receives the bottomhole assembly and the tubing. A drilling fluid system supplies a drilling fluid into the tubing, which discharges at the drill bit and returns to the well control equipment carrying the drill cuttings via the annulus between the drill string and the wellbore. A riser dispersed between the wellhead equipment and the surface guides the drill string and provides a conduit for moving the returning fluid to the surface.

An active pressure differential (APD) device moves in the wellbore as the drill string is moved. Alternatively, the active differential pressure device is attached to the wellbore inside or wall and remains stationary relative to the wellbore during drilling. The device is operated during drilling, i.e., when the drilling fluid is circulating through the wellbore, to create a pressure differential across the device. This pressure differential alters the pressure on the wellbore below or downhole of the device. The device may be controlled to reduce the bottomhole pressure by a certain amount, to maintain the bottomhole pressure at a certain value, or within a certain range. By severing or restricting the flow through the device, the bottomhole pressure may be increased.

The system also includes downhole devices for performing a variety of functions. Exemplary downhole devices include devices that control the drilling flow rate and flow paths. For example, the system can include one or more flow-control devices that can stop the flow of the fluid in the drill string and/or the annulus. Such flow-control devices can be configured to direct fluid in drill string into the annulus and/or bypass return fluid around the APD device. Another exemplary downhole device can be configured for processing the cuttings (e.g., reduction of cutting size) and other debris flowing in the annulus. For example, a comminution device can be disposed in the annulus upstream of the APD device.

Sensors communicate with a controller via a telemetry system to maintain the wellbore pressure at a zone of interest at a selected pressure or range of pressures. The sensors are strategically positioned throughout the system to provide information or data relating to one or more selected parameters of interest such as drilling parameters, drilling assembly or BHA parameters, and formation or formation evaluation parameters. The controller for suitable for drilling operations preferably includes programs for maintaining the wellbore pressure at zone at under-balance condition, at at-balance condition or at over-balanced condition. The controller may be programmed to activate downhole devices according to programmed instructions or upon the occurrence of a particular condition.

Exemplary configurations for the APD Device and associated drive includes a moineau-type pump coupled to positive displacement motor/drive via a shaft assembly. Another exemplary configuration includes a turbine drive coupled to a centrifugal-type pump via a shaft assembly. Preferably, a high-pressure seal separates a supply fluid flowing through the motor from a return fluid flowing through the pump. In a preferred embodiment, the seal is configured to bear either or both of radial and axial (thrust) forces.

In still other configurations, a positive displacement motor can drive an intermediate device such as a hydraulic motor, which drives the APD Device. Alternatively, a jet pump can be used, which can eliminate the need for a drive/motor. Moreover, pumps incorporating one or more pistons, such as hammer pumps, may also be suitable for certain applications. In still other configurations, the APD Device can be driven by an electric motor. The electric motor can be positioned external to a drill string or formed integral with a drill string. In a preferred arrangement, varying the speed of the electrical motor directly controls the speed of the rotor in the APD device, and thus the pressure differential across the APD Device.

Bypass devices are provided to allow fluid circulation in the wellbore during tripping of the system, to control the operating set points of the APD Device and/or associated drive/motor, and to provide a discharge mechanism to relieve fluid pressure. For examples, the bypass devices can selectively channel fluid around the motor/drive and the APD Device and selectively discharge drilling fluid from the drill string into the annulus. In one arrangement, the bypass device for the pump can also function as a particle bypass line for the APD device. Alternatively, a separate particle bypass can be used in addition to the pump bypass for such a function.

In order for the APD to function properly, a fluid seal must be established and maintained between the APD and the inner wall of the borehole and the outer surface of the pump. This seal is intended to be maintained during drilling. Therefore, an acceptable annular seal arrangement must perform several functions. First, the seal assembly must properly seal against the cased wellbore wall while the drill string is rotating and/or moving axially within the wellbore. Second, the seal assembly should move axially along the wellbore wall without significant damage resulting to the seal. Third, the seal should allow mud to bypass the seal while tripping.

There are difficulties with conventional seal solutions for this type of problem. A conventional rubber sealing on the outer surface of the tool, for example, or a brush seal would be prone to excessive erosion damage since the seal would have to slide along the inner surface of the casing and the casing couplings until the APD device is moved to its target depth. The risk of significantly damaging this type of seal during tripping is very high.

SUMMARY OF THE INVENTION

The present invention provides devices and methods for establishing an effective annular seal about between an APD and a surrounding wellbore sidewall. In other aspects, the invention provides a means of selectively activating such a seal during drilling operations or other operations wherein drilling mud is flowed through the drill string and returns through the annulus.

An annular seal assembly is described that creates a fluid seal between an APD and a wellbore sidewall during drilling operations. In a currently preferred embodiment, the annular seal assembly includes an inflatable packer element and a hydraulic inflation system. The hydraulic inflation system uses the fluid pressure provided by drilling mud that is returning to the surface via the annulus to inflate the packer element and set the seal. The hydraulic inflation system also buffers and regulates the fluid pressure setting the packer element to avoid overinflation of the element. Because drilling mud fluid pressure actuates the seal assembly, the seal is automatically set during drilling operations and unset when drilling ceases, thereby allowing the pump assembly to be easily relocated or removed from the wellbore following a drilling operation. The use of an inflatable packer element also ensures that the fluid seal provided by the seal assembly is somewhat flexible and resilient and, therefore, able to be moved upwardly and downwardly within the wellbore during drilling and to permit the passage by the pump housing of drilling mud returning to the surface via the annulus. In other embodiments, the seal assembly may comprise a set of mud cups that are set against the borehole sidewall using a pressure differential across the seal assembly or a spring-biased seal element.

Examples of the more important features of the invention have been summarized (albeit rather broadly) in order that the detailed description thereof that follows may be better understood and in order that the contributions they represent to the art may be appreciated. There are, of course, additional features of the invention that will be described hereinafter and which will form the subject of the claims appended hereto.

BRIEF DESCRIPTION OF THE DRAWINGS

For detailed understanding of the present invention, reference should be made to the following detailed description of the preferred embodiment, taken in conjunction with the accompanying drawing.

DETAILED DESCRIPTION OF PREFERRED EMBODIMENTS

Figure 1:
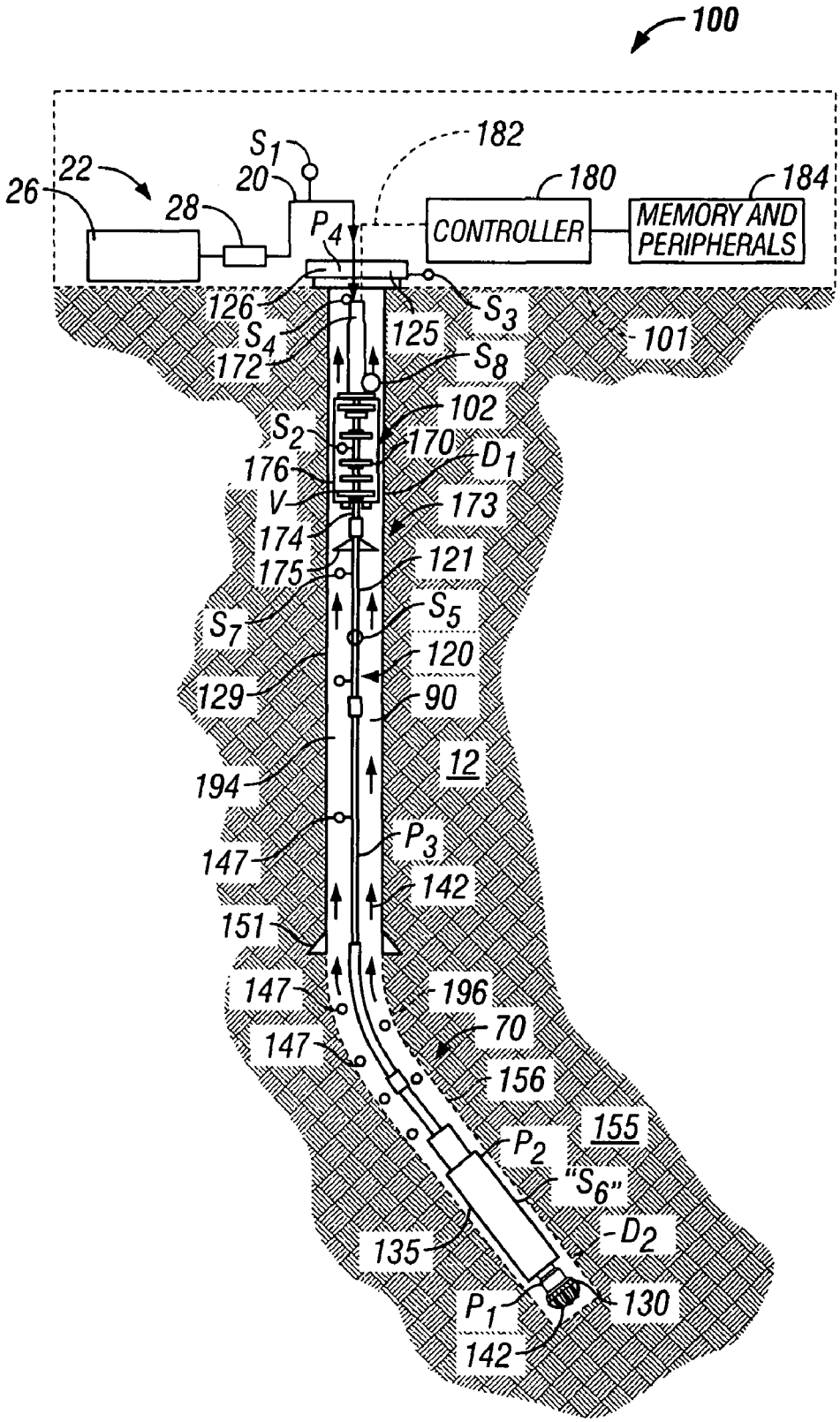
FIG. 1 is a schematic illustration of one embodiment of a system using an active pressure differential device to manage pressure in a predetermined wellbore location.

Referring initially to FIG. 1, there is schematically illustrated a system for performing one or more operations related to the construction, logging, completion or workover of a hydrocarbon producing well. In particular, FIG. 1 shows a schematic elevation view of one embodiment of a wellbore drilling system 100 for drilling wellbore 90 using conventional drilling fluid circulation. The drilling system 100 is a rig for land wells and includes a drilling platform 101, which may be a drill ship or another suitable surface workstation such as a floating platform or a semi-submersible for offshore wells. For offshore operations, additional known equipment such as a riser and subsea wellhead will typically be used. To drill a wellbore 90, well control equipment 125 (also referred to as the wellhead equipment) is placed above the wellbore 90. The wellhead equipment 125 includes a blow-out-preventer stack 126 and a lubricator (not shown) with its associated flow control.

This system 100 further includes a well tool such as a drilling assembly or a bottomhole assembly ("BHA") 135 at the bottom of a suitable umbilical such as drill string or tubing 121 (such terms will be used interchangeably). In a preferred embodiment, the BHA 135 includes a drill bit 130 adapted to disintegrate rock and earth. The bit can be rotated by a surface rotary drive or a motor using pressurized fluid (e.g., mud motor) or an electrically driven motor. The tubing 121 can be formed partially or fully of drill pipe, metal or composite coiled tubing, liner, casing or other known members. Additionally, the tubing 121 can include data and power transmission carriers such fluid conduits, fiber optics, and metal conductors. Conventionally, the tubing 121 is placed at the drilling platform 101. To drill the wellbore 90, the BHA 135 is conveyed from the drilling platform 101 to the wellhead equipment 125 and then inserted into the wellbore 90. The tubing 121 is moved into and out of the wellbore 90 by a suitable tubing injection system.

During drilling, a drilling fluid from a surface mud system 22 is pumped under pressure down the tubing 121 (a "supply fluid"). The mud system 22 includes a mud pit or supply source 26 and one or more pumps 28. In one embodiment, the supply fluid operates a mud motor in the BHA 135, which in turn rotates the drill bit 130. The drill string 121 rotation can also be used to rotate the drill bit 130, either in conjunction with or separately from the mud motor. The drill bit 130 disintegrates the formation (rock) into cuttings 147. The drilling fluid leaving the drill bit travels uphole through the annulus 194 between the drill string 121 and the wellbore wall or inside 196, carrying the drill cuttings 147 therewith (a "return fluid"). The return fluid discharges into a separator (not shown) that separates the cuttings 147 and other solids from the return fluid and discharges the clean fluid back into the mud pit 26. As shown in FIG. 1, the clean mud is pumped through the tubing 121 while the mud with cuttings 147 returns to the surface via the annulus 194 up to the wellhead equipment 125.

Once the well 90 has been drilled to a certain depth, casing 129 with a casing shoe 151 at the bottom is installed. The drilling is then continued to drill the well to a desired depth that will include one or more production sections, such as section 155. The section below the casing shoe 151 may not be cased until it is desired to complete the well, which leaves the bottom section of the well as an open hole, as shown by numeral 156.

As noted above, the present invention provides a drilling system for controlling bottomhole pressure at a zone of interest designated by the numeral 155 and thereby the ECD effect on the wellbore. In one embodiment of the present invention, to manage or control the pressure at the zone 155, an active pressure differential device ("APD Device") 170 is fluidly coupled to return fluid downstream of the zone of interest 155. The APD device is a device that is capable of creating a pressure differential "ΔP" across the device. This controlled pressure drop reduces the pressure upstream of the APD Device 170 and particularly in zone 155.

The system 100 also includes downhole devices that separately or cooperatively perform one or more functions such as controlling the flow rate of the drilling fluid and controlling the flow paths of the drilling fluid. For example, the system 100 can include one or more flow-control devices that can stop the flow of the fluid in the drill string and/or the annulus 194. FIG. 1 shows an exemplary flow-control device 173 that includes a device 174 that can block the fluid flow within the drill string 121 and a device 175 that blocks can block fluid flow through the annulus 194. The device 173 can be activated when a particular condition occurs to insulate the well above and below the flow-control device 173. For example, the flow-control device 173 may be activated to block fluid flow communication when drilling fluid circulation is stopped so as to isolate the sections above and below the device 173, thereby maintaining the wellbore below the device 173 at or substantially at the pressure condition prior to the stopping of the fluid circulation.

The flow-control devices 174, 175 can also be configured to selectively control the flow path of the drilling fluid. For example, the flow-control device 174 in the drill pipe 121 can be configured to direct some or all of the fluid in drill string 121 into the annulus 194. Moreover, one or both of the flow-control devices 174, 175 can be configured to bypass some or all of the return fluid around the APD device 170. Such an arrangement may be useful, for instance, to assist in lifting cuttings to the surface. The flow-control device 173 may include check-valves, packers and any other suitable device. Such devices may automatically activate upon the occurrence of a particular event or condition.

The system 100 also includes downhole devices for processing the cuttings (e.g., reduction of cutting size) and other debris flowing in the annulus 194. For example, a comminution device 176 can be disposed in the annulus 194 upstream of the APD device 170 to reduce the size of entrained cutting and other debris. The comminution device 176 can use known members such as blades, teeth, or rollers to crush, pulverize or otherwise disintegrate cuttings and debris entrained in the fluid flowing in the annulus 194. The comminution device 176 can be operated by an electric motor, a hydraulic motor, by rotation of drill string or other suitable means. The comminution device 176 can also be integrated into the APD device 170. For instance, if a multi-stage turbine is used as the APD device 170, then the stages adjacent the inlet to the turbine can be replaced with blades adapted to cut or shear particles before they pass through the blades of the remaining turbine stages.

Sensors $S_{1-n}$ are strategically positioned throughout the system 100 to provide information or data relating to one or more selected parameters of interest (pressure, flow rate, temperature). In a preferred embodiment, the downhole devices and sensors $S_{1-n}$ communicate with a controller 180 via a telemetry system (not shown). Using data provided by the sensors $S_{1-n}$, the controller 180 maintains the wellbore pressure at zone 155 at a selected pressure or range of pressures. The controller 180 maintains the selected pressure by controlling the APD device 170 (e.g., adjusting amount of energy added to the return fluid line) and/or the downhole devices (e.g., adjusting flow rate through a restriction such as a valve).

When configured for drilling operations, the sensors $S_{1-n}$ provide measurements relating to a variety of drilling parameters, such as fluid pressure, fluid flow rate, rotational speed of pumps and like devices, temperature, weight-on bit, rate of penetration, etc., drilling assembly or BHA parameters, such as vibration, stick slip, RPM, inclination, direction, BHA location, etc. and formation or formation evaluation parameters commonly referred to as measurement-while-drilling parameters such as resistivity, acoustic, nuclear, NMR, etc. One preferred type of sensor is a pressure sensor for measuring pressure at one or more locations. Referring still to FIG. 1A, pressure sensor $P_1$ provides pressure data in the BHA, sensor $P_2$ provides pressure data in the annulus, pressure sensor $P_3$ in the supply fluid, and pressure sensor $P_4$ provides pressure data at the surface. Other pressure sensors may be used to provide pressure data at any other desired place in the system 100. Additionally, the system 100 includes fluid flow sensors such as sensor V that provides measurement of fluid flow at one or more places in the system.

Further, the status and condition of equipment as well as parameters relating to ambient conditions (e.g., pressure and other parameters listed above) in the system 100 can be monitored by sensors positioned throughout the system 100: exemplary locations including at the surface (S1), at the APD device 170 (S2), at the wellhead equipment 125 (S3), in the supply fluid (S4), along the tubing 121 (S5), at the well tool 135 (S6), in the return fluid upstream of the APD device 170 (S7), and in the return fluid downstream of the APD device 170 (S8). It should be understood that other locations may also be used for the sensors $S_{1-n}$.

The controller 180 for suitable for drilling operations preferably includes programs for maintaining the wellbore pressure at zone 155 at under-balance condition, at at-balance condition or at over-balanced condition. The controller 180 includes one or more processors that process signals from the various sensors in the drilling assembly and also controls their operation. The data provided by these sensors $S_{1-n}$ and control signals transmitted by the controller 180 to control downhole devices such as devices 173–176 are communicated by a suitable two-way telemetry system (not shown). A separate processor may be used for each sensor or device. Each sensor may also have additional circuitry for its unique operations. The controller 180, which may be either downhole or at the surface, is used herein in the generic sense for simplicity and ease of understanding and not as a limitation because the use and operation of such controllers is known in the art. The controller 180 preferably contains one or more microprocessors or micro-controllers for processing signals and data and for performing control functions, solid state memory units for storing programmed instructions, models (which may be interactive models) and data, and other necessary control circuits. The microprocessors control the operations of the various sensors, provide communication among the downhole sensors and provide two-way data and signal communication between the drilling assembly 30, downhole devices such as devices 173–175 and the surface equipment via the two-way telemetry. In other embodiments, the controller 180 can be a hydromechanical device that incorporates known mechanisms (valves, biased members, linkages cooperating to actuate tools under, for example, preset conditions).

For convenience, a single controller 180 is shown. It should be understood, however, that a plurality of controllers 180 can also be used. For example, a downhole controller can be used to collect, process and transmit data to a surface controller, which further processes the data and transmits appropriate control signals downhole. Other variations for dividing data processing tasks and generating control signals can also be used.

In general, however, during operation, the controller 180 receives the information regarding a parameter of interest and adjusts one or more downhole devices and/or APD device 170 to provide the desired pressure or range or pressure in the vicinity of the zone of interest 155. For example, the controller 180 can receive pressure information from one or more of the sensors ($S_1$–$S_n$) in the system 100. The controller 180 may control the APD Device 170 in response to one or more of: pressure, fluid flow, a formation characteristic, a wellbore characteristic and a fluid characteristic, a surface measured parameter or a parameter measured in the drill string. The controller 180 determines the ECD and adjusts the energy input to the APD device 170 to maintain the ECD at a desired or predetermined value or within a desired or predetermined range. The wellbore system 100 thus provides a closed loop system for controlling the ECD in response to one or more parameters of interest during drilling of a wellbore. This system is relatively simple and efficient and can be incorporated into new or existing drilling systems and readily adapted to support other well construction, completion, and work-over activities.

In the embodiment shown in FIG. 1, the APD Device 170 is shown as a turbine attached to the drill string 121 that operates within the annulus 194. Other embodiments, described in further detail below can include centrifugal pumps, positive displacement pump, jet pumps and other like devices. During drilling, the APD Device 170 moves in the wellbore 90 along with the drill string 121. The return fluid can flow through the APD Device 170 whether or not the turbine is operating. However, the APD Device 170, when operated creates a differential pressure thereacross.

As described above, the system 100 in one embodiment includes a controller 180 that includes a memory and peripherals 184 for controlling the operation of the APD Device 170, the devices 173–176, and/or the bottomhole assembly 135. In FIG. 1, the controller 180 is shown placed at the surface. It, however, may be located adjacent the APD Device 170, in the BHA 135 or at any other suitable location. The controller 180 controls the APD Device to create a desired amount of $\Delta P$ across the device, which alters the bottomhole pressure accordingly. Alternatively, the controller 180 may be programmed to activate the flow-control device 173 (or other downhole devices) according to programmed instructions or upon the occurrence of a particular condition. Thus, the controller 180 can control the APD Device in response to sensor data regarding a parameter of interest, according to programmed instructions provided to said APD Device, or in response to instructions provided to said APD Device from a remote location. The controller 180 can, thus, operate autonomously or interactively.

During drilling, the controller 180 controls the operation of the APD Device to create a certain pressure differential across the device so as to alter the pressure on the formation or the bottomhole pressure. The controller 180 may be programmed to maintain the wellbore pressure at a value or range of values that provide an under-balance condition, an at-balance condition or an over-balanced condition. In one embodiment, the differential pressure may be altered by altering the speed of the APD Device. For instance, the bottomhole pressure may be maintained at a preselected value or within a selected range relative to a parameter of interest such as the formation pressure. The controller 180 may receive signals from one or more sensors in the system 100 and in response thereto control the operation of the APD Device to create the desired pressure differential. The controller 180 may contain pre-programmed instructions and autonomously control the APD Device or respond to signals received from another device that may be remotely located from the APD Device.

Figure 2:
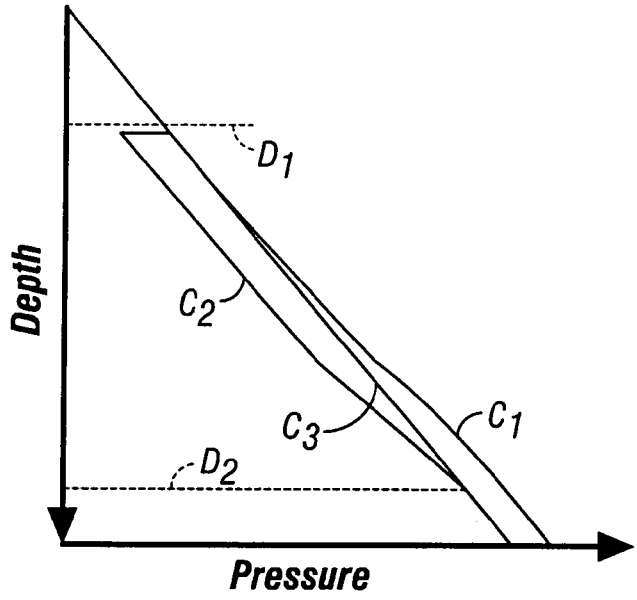
FIG. 2 graphically illustrates the effect of an operating active pressure differential device upon the pressure at a predetermined wellbore location.

FIG. 2 graphically illustrates the ECD control provided by the above-described embodiment of the present invention and references FIG. 1 for convenience. FIG. 1 shows the APD device 170 at a depth D1 and a representative location in the wellbore in the vicinity of the well tool 30 at a lower depth D2. FIG. 2 provides a depth versus pressure graph having a first curve C1 representative of a pressure gradient before operation of the system 100 and a second curve C2 representative of a pressure gradients during operation of the system 100. Curve C3 represents a theoretical curve wherein the ECD condition is not present; i.e., when the well is static and not circulating and is free of drill cuttings. It will be seen that a target or selected pressure at depth D2 under curve C3 cannot be met with curve C1. Advantageously, the system 100 reduces the hydrostatic pressure at depth D1 and thus shifts the pressure gradient as shown by curve C3, which can provide the desired predetermined pressure at depth D2. In most instances, this shift is roughly the pressure drop provided by the APD device 170.

Referring now to FIGS. 3A–D, there is schematically illustrated one arrangement wherein a positive displacement motor/drive 200 is coupled to a moineau-type pump 220 via a shaft assembly 240. The motor 200 is connected to an upper string section 260 through which drilling fluid is pumped from a surface location. The pump 220 is connected to a lower drill string section 262 on which the bottomhole assembly (not shown) is attached at an end thereof. The motor 200 includes a rotor 202 and a stator 204. Similarly, the pump 220 includes a rotor 222 and a stator 224. The design of moineau-type pumps and motors are known to one skilled in the art and will not be discussed in further detail.

Additionally, an annular seal assembly 299 is disposed around the APD device to direct the return fluid to flow into the pump 220 (or more generally, the APD device) and to allow a pressure differential across the pump 220. The seal 299 is an expandable packer type element that expands/contracts upon receiving a command signal to substantially prevent the return fluid from flowing between the pump 220 (or more generally, the APD device) and the casing c or wellbore wall. Construction and operation of exemplary constructions for the annular seal assembly 299 is described in detail below, with respect to FIGS. 4, 5, 6, 7, 8, 9, 10, 11 and 12.

Figure 6:
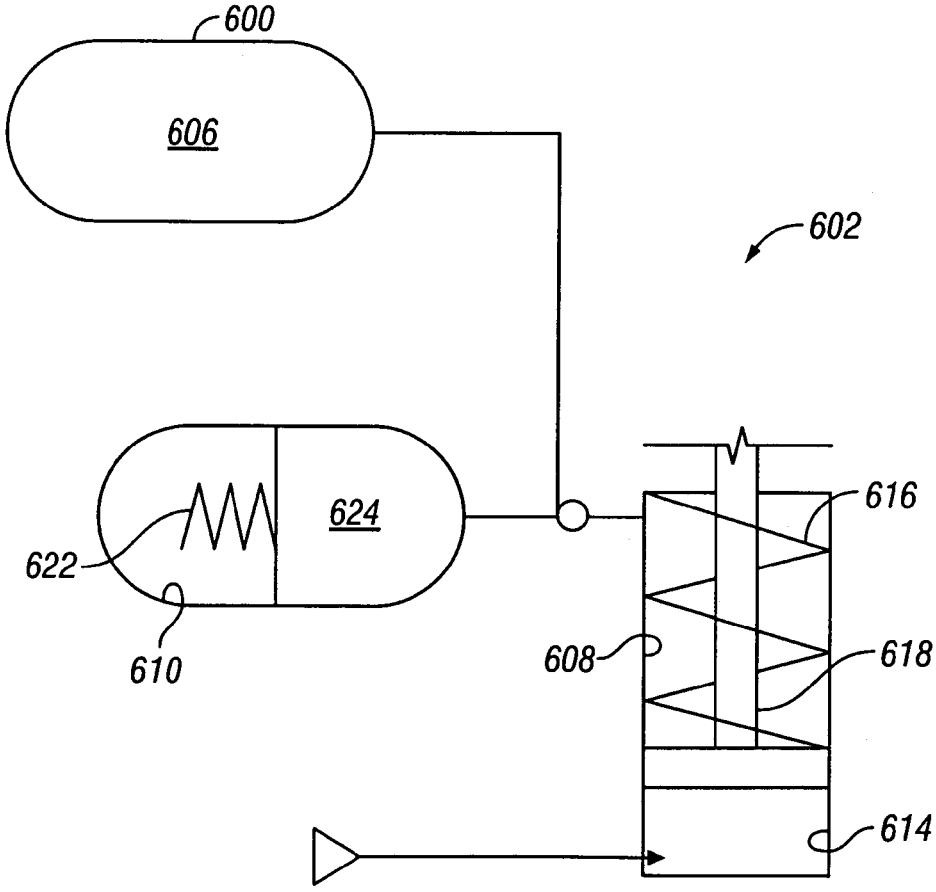
FIG. 6 is a schematic depiction of the hydraulic inflation system used in the exemplary annular seal assembly shown in FIGS. 4 and 5.
Figure 3A:
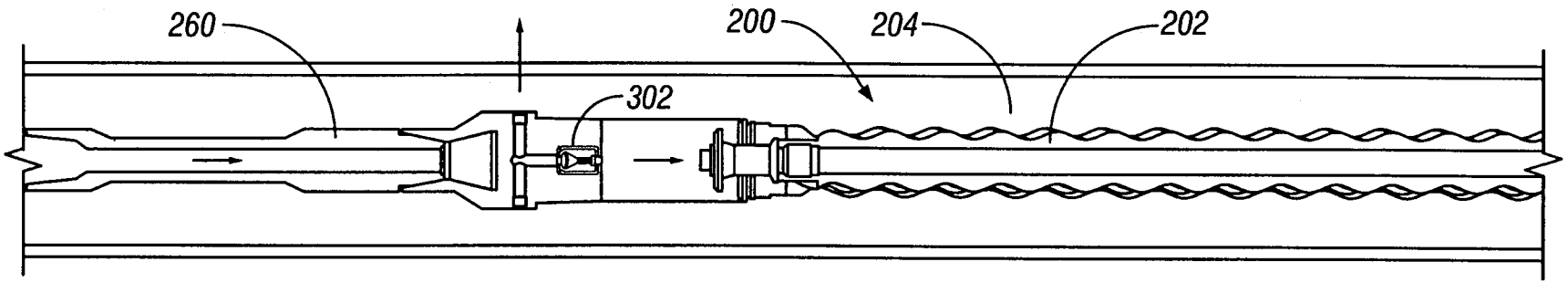
FIGS. 3A–D are schematic illustrations of one embodiment of an arrangement according to the present invention wherein a positive displacement motor is coupled to a positive displacement pump (the APD Device)
Figure 3B:
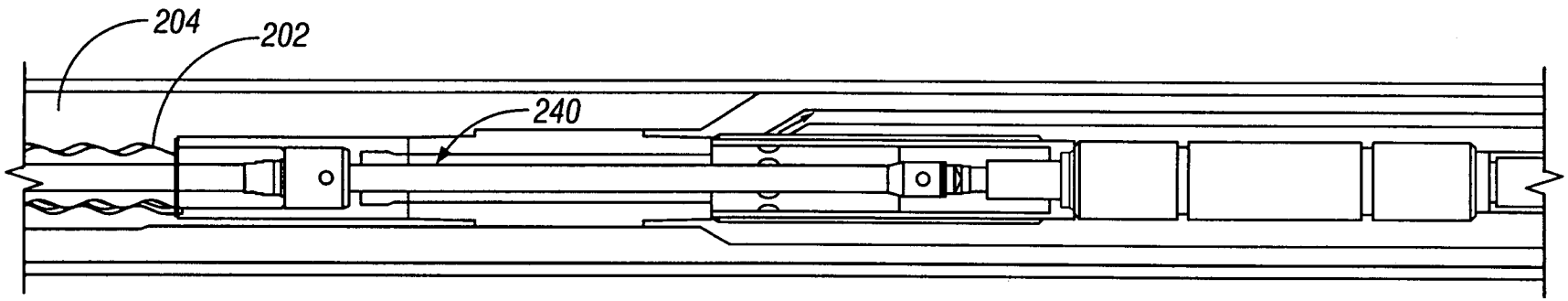
Figure 3C:
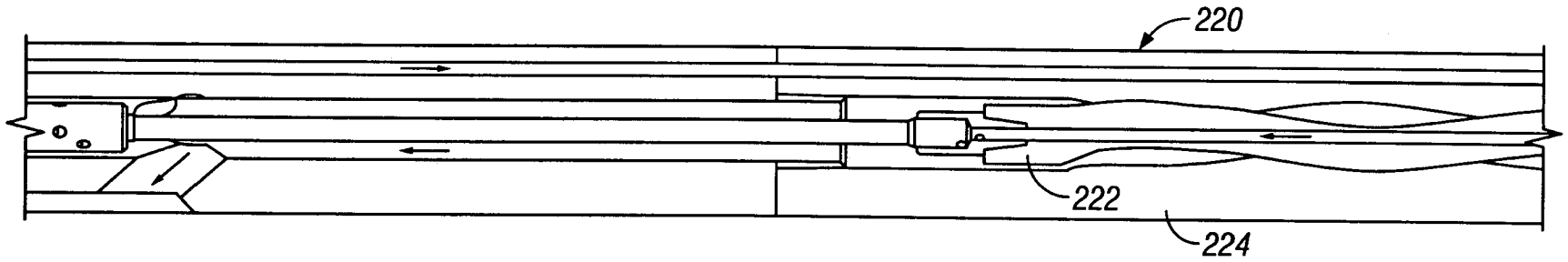
Figure 3D:
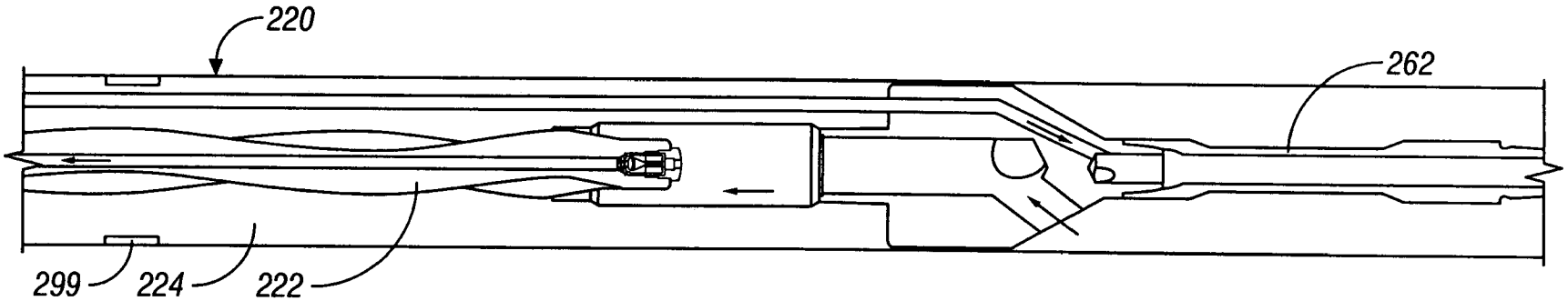
Figure 4:
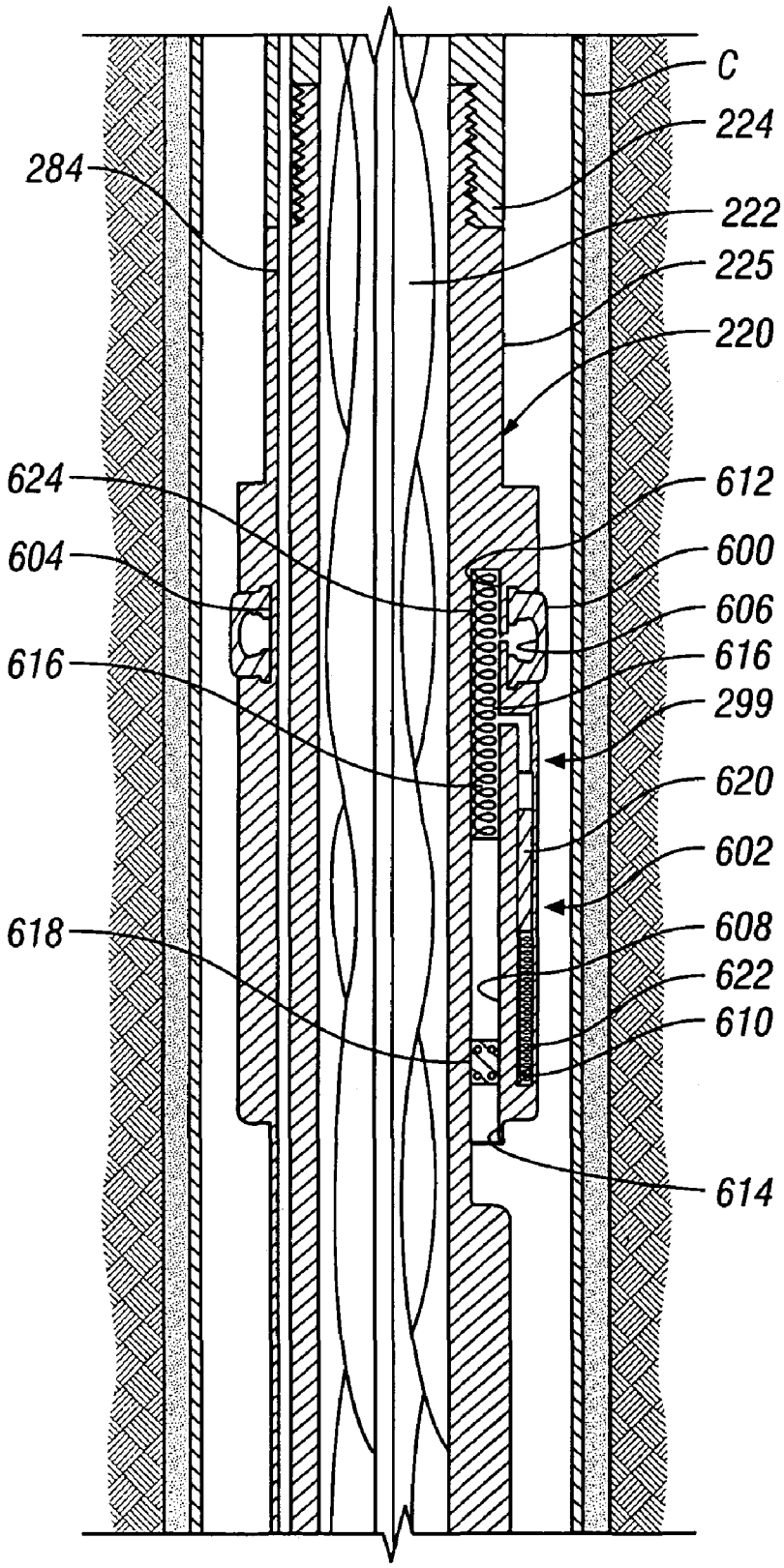
FIG. 4 is a side, cross-sectional view of an exemplary annular seal assembly constructed in accordance with the present invention wherein the seal assembly is in an unset position.
Figure 5:
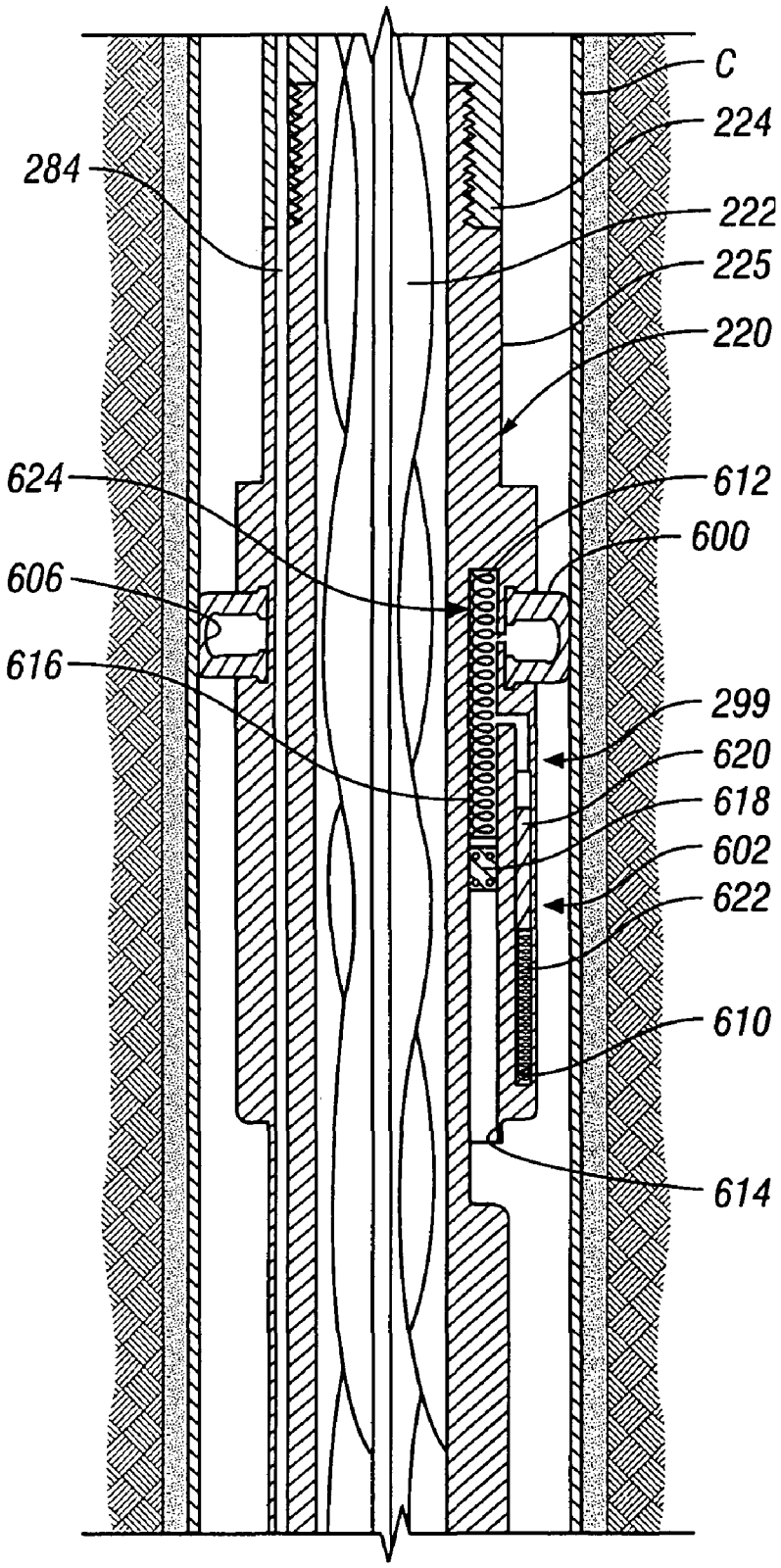
FIG. 5 is a side, cross-sectional view of the exemplary annular seal assembly shown in FIG. 7 with the seal assembly in a set position.

The annular seal assembly 299, depicted in FIG. 3D is better understood with reference to FIGS. 4, 5, and 6, as well as the alternative embodiments depicted in FIGS. 7–12. The annular seal assembly 299 includes a hydraulically inflatable annular packer element 600 and a hydraulic inflation system, shown generally at 602, that selectively inflates the element 600 for contact with the casing c. As noted previously, the annular seal assembly 299 radially surrounds the pump casing 225 of the APD device 170, and more specifically, the pump 220. Preferably, the packer element 600 is made of elastomer and is conveniently integrated directly into the outer casing or housing 225 of the pump 220. The inflatable packer element 600 is an elastomeric element that resides within an annular groove 604 and defines a fluid channel 606 therewithin. The fluid channel 606 is in hydraulic fluid communication with the hydraulic inflation system 602.

The hydraulic inflation system 602 is essentially a buffered system that uses fluid pressure from the flow of drilling mud to inflate the packer element 600. In a currently preferred embodiment, the hydraulic inflation system 602 includes a pair of cylinders 608 and 610 that are disposed in a side-by-side manner and interconnect to form a cavity 612 at their upper end. The cavity 612 is in communication with the fluid channel 606 of the inflatable element 600. The first cylinder 608 has a lower end 614 that is open to fluid pressure from drilling mud returning to the surface of the wellbore via return flow path 292. It is noted that, in the embodiment depicted in FIGS. 7 and 8, the open lower end 614 is located on the radial exterior of the pump 220. The first cylinder 608 also houses a compressible spring 616 and a first piston member 618. The second cylinder 610 houses a second piston member 620 therewithin. There is also a compressible spring 622 defined within the second cylinder 610. It is preferred that the second spring 622 provides a greater compression force than the first spring 616. The compressible springs 616, 622 may comprise mechanical springs or compressible fluid springs.

Figure 9:
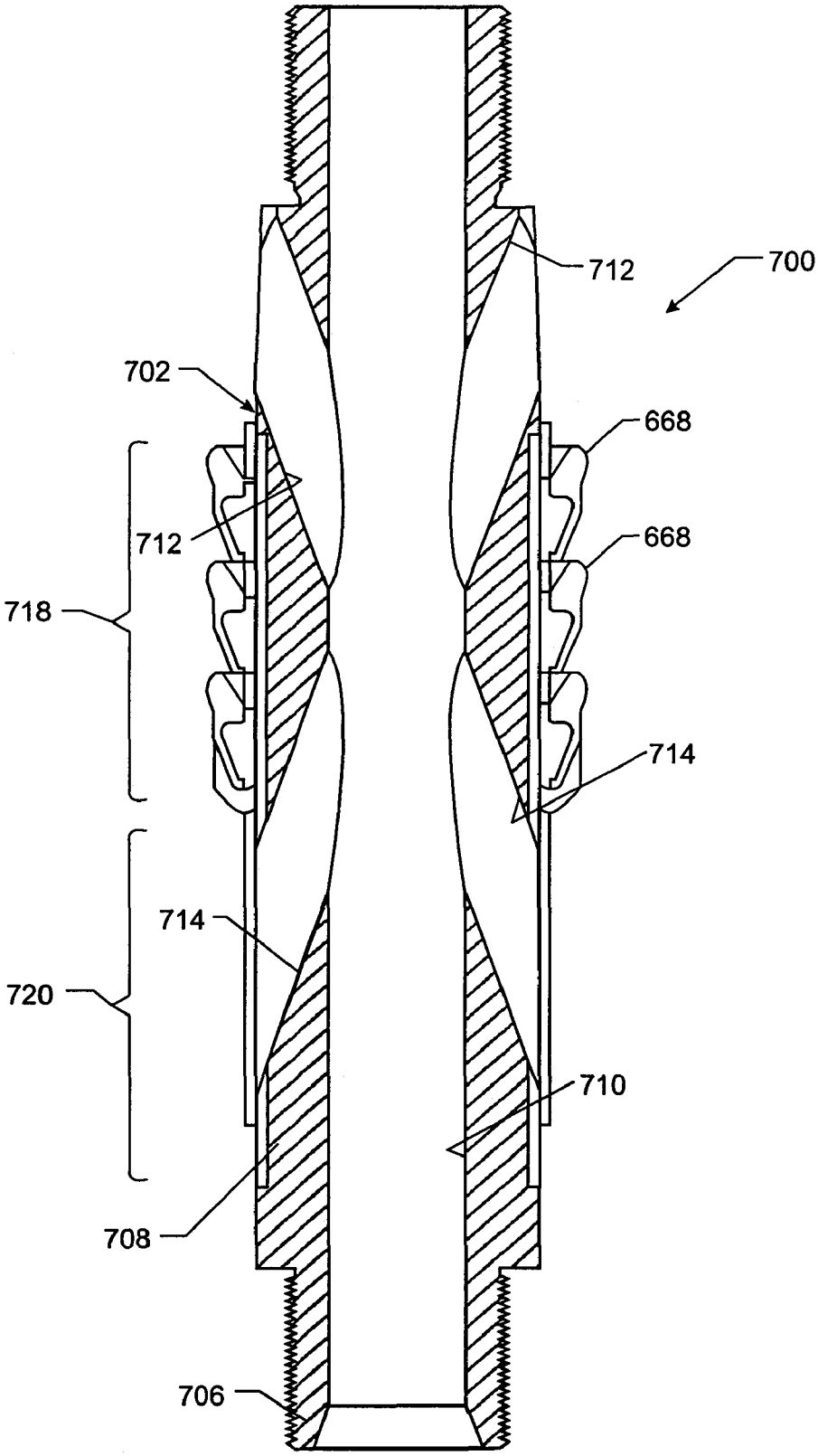
FIG. 9 is a side, cross-sectional view of another alternative embodiment for an annular seal assembly that incorporates a set of mud cups and a string valve.

A hydraulic fluid chamber, shown generally at 624, is defined within the upper portions of the first and second cylinders 608, 610 between the first and second piston members 618 and 620. The hydraulic fluid chamber 624 also includes the cavity 612 as well as the fluid channel 606 within the inflatable element 600. The hydraulic fluid chamber 624 is filled with clean hydraulic fluid. FIG. 9 provides a schematic illustration of the hydraulic inflation system 602 of the annular seal assembly 299 to help better illustrate its operation.

The annular seal assembly 299 is actuated to inflate the packer element 600 during flowing of drilling mud, such as during drilling, and return of the drilling mud to the surface of the well. Drilling mud enters the open, lower end 614 of the first cylinder 608, thereby exerting fluid pressure against the lower side of the first piston 618 and urging it upwardly within the first cylinder 608. Upward movement of the first piston 618 will urge hydraulic fluid within the hydraulic fluid chamber 624 into the fluid channel 606 of the packer element 600, causing the element 600 to inflate. Because fluid pressure from drilling mud flow is typically very high, the hydraulic inflation system 602 provides buffering so that the packer element 600 is not overinflated to failure. The second spring 622 and the second piston member 620 provide buffering. Excessive fluid pressure exerted upon the first piston member 618 by the drilling mud will be absorbed by compression of the second spring 622.

The annular seal assembly 299 provides a selectively actuatable fluid seal and one that is also somewhat resilient and flexible so that the pump 220 may be moved axially upward and downward within the casing c during drilling operations. Certain features of the annular seal assembly 299 provide for reduced friction forces between the packer element 600 and the casing c of the wellbore to facilitate axial movement of the pump 220 within. First, the amount of radial expansion of the packer element 600 is small, as compared to that of conventional inflatable packer elements that are used to separate zones within a wellbore and the like in a relatively permanent or semi permanent manner. As a result, the contact area between the packer element 600 and the casing c is minimized. Additionally, a lubricant, such as TEFLON®, may be used to coat the outer contacting portion of the inflatable element 600 to reduce frictional forces. Additionally, the fluid seal should be able to yield to permit drilling mud returning to the surface via the annulus to bypass the pump 220.

Figure 7:
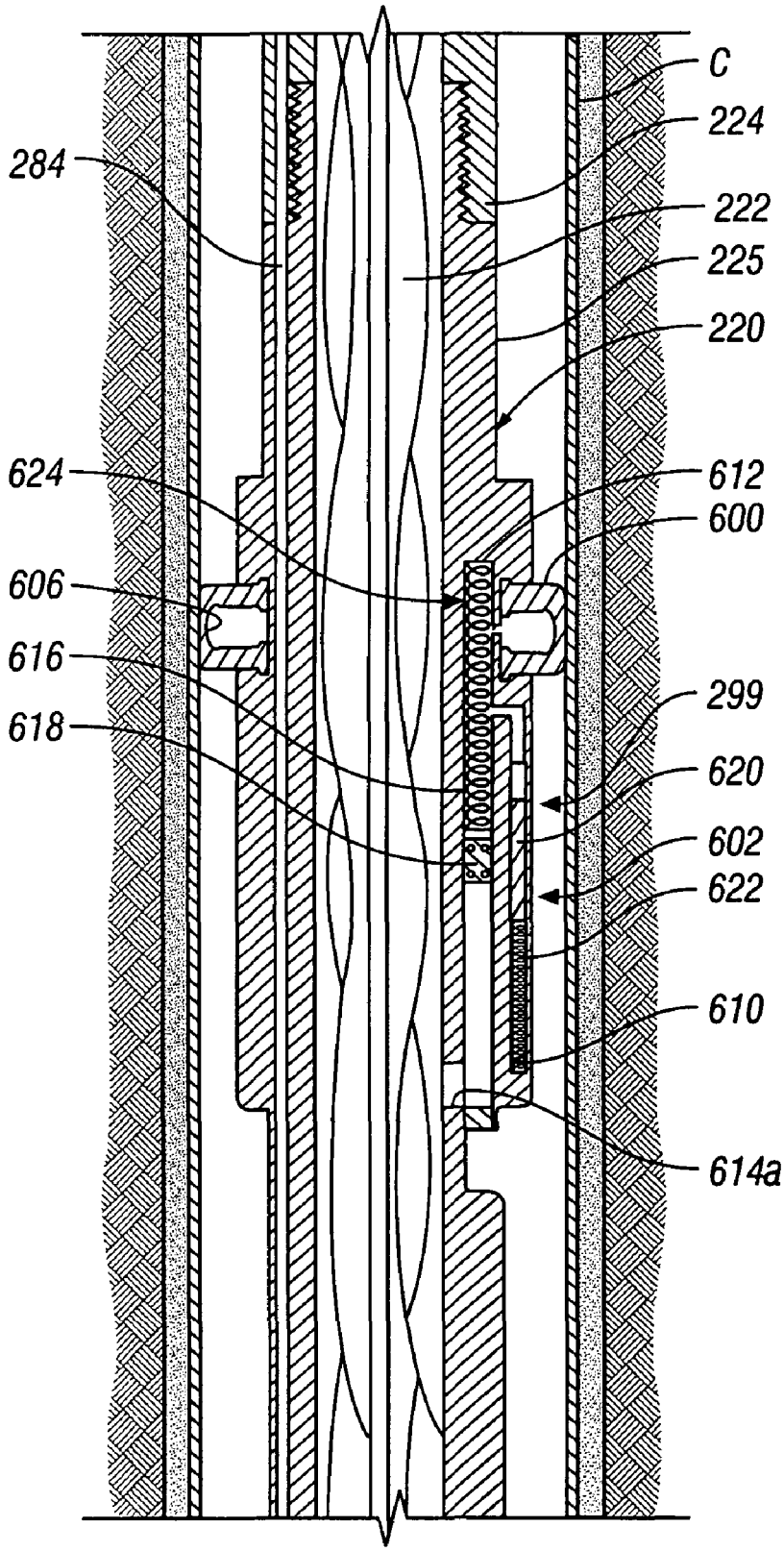
FIG. 7 is a side, cross-sectional view of an alternative embodiment for an annular seal assembly.

In an alternative embodiment depicted in FIG. 7, the packer element 600 of seal assembly 299' is selectively inflated using pressure within, rather than outside of the drill pipe. In this embodiment, the open end 614A of the first cylinder 608 is exposed to the radial interior of the pump 220. As a result, drilling mud entering the drill string to drive the rotor 222 within the stator 224 is used to inflate the packer element 600.

Figure 8:
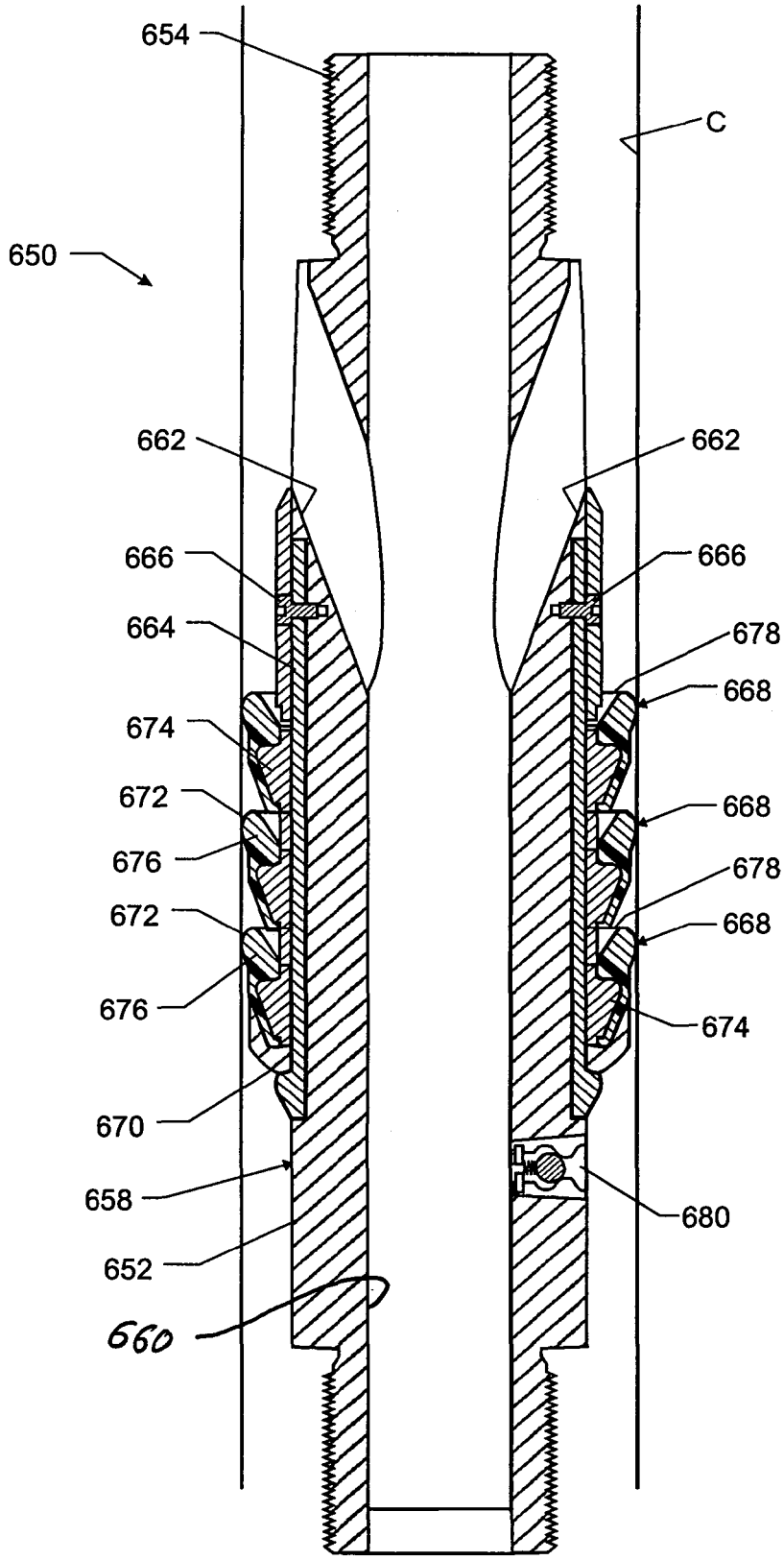
FIG. 8 is a side, cross-sectional view of a further alternative embodiment for an annular seal assembly that incorporates a set of mud cups around the outer circumference and a trip valve.

FIG. 8 shows an alternative annular seal arrangement 650 that can provide the annular seal assembly 299 for the APD device 170. The seal arrangement 650 includes a cylindrical housing 652 having an upper connecting end 654 that will, during use, be oriented uphole and a lower connecting end 656 that are used to operably interconnect the housing 652 within the drill string 121 so that the pump inlet is hydraulically separated from the pump outlet. A radially enlarged central portion 658 of the housing 652 is defined between the two axial ends 654, 656. An axial mud passage 660 is centrally defined along the length of the housing 652, and a pair of branch passages 662 extends within an upper part of the central portion to interconnect the central mud passage 660 with the radial exterior of the housing 652.

The radially enlarged central portion 658 of the housing 652 carries thereupon a plurality (three shown) radially deformable seals in the form of mud cups 668. The mud cups 668 annularly surround the central portion 658 and are affixed thereto, as indicated schematically by attachment portions 664. The mud cups 668 are each shaped to form a flap that is fastened at a lower end to a sleeve stabilizer 670 and extend outwardly and upwardly from the sleeve stabilizer 670 to terminate in a contacting portion 672. In currently preferred embodiments, the mud cups 668 are fashioned of a metal ring member 674 that is encapsulated by a flap portion 676 that is fashioned from a plastic or elastomeric material. The flap portion 676 of the mud cups 668 has a shape memory with an outward bias that enables the contacting portion 672 of each mud cup 668 to be expanded radially outwardly into contact with the casing c. The flap portion 676 of each of the mud cups 668 curves upwardly to form a concavity 678 within which fluid may be retained. The securing members 666 prevent movement of the sleeve 664 with respect to the housing 652. Additionally, the securing members 666 may be removed in order to replace the sleeve 664 with an alternative sleeve having larger or smaller mud cups 668 in order to accommodate different sizes of wellbores. A trip valve 680 is disposed through the wall of the housing 652. The trip valve 680 is a check valve that permits one-way flow of fluids from the exterior of the housing 652 into the axial mud passage 660. It is noted that the trip valve 680 is located axially below the mud cups 668, and the branch passages 662 are located axially above the mud cups 668.

In operation, the seal arrangement 650 is a static seal that is intended to be set permanently within the casing c of the wellbore. When the seal arrangement 650 is run into the wellbore, the contacting portions 672 of the mud cups 668 are in contact with the casing c and move along it. As the seal arrangement 650 is run into the wellbore, fluids within the wellbore that are below the seal arrangement 650 are displaced and may flow through the trip valve 680 into the axial mud passage 660 and then through the branch passages 662 out into the annulus. In this manner, wellbore fluids are able to bypass the seal arrangement 650 as it is run into the wellbore or when it is removed from the wellbore (i.e., during pulling out). When the seal arrangement 650 reaches the desired position within the wellbore, it may be set against the casing c by energizing the motor 200 and pump 220 to circulate drilling mud downwardly through the axial mud passage 660. When this occurs, hydraulic pressure is decreased within the annulus below the seal assembly 650 as compared to the pressure within the mud passage 660, and the trip valve 680 is closed to fluid flow. As a result, borehole fluids are prevented from bypassing the seal assembly 650. Annulus fluid pressure below the seal arrangement 650 will also be less than the annulus fluid pressure above the seal arrangement 650. Pressurized fluid in the concavities 678 of the mud cups 668 then reinforces and sets the contacting portions 672 of the mud cups 668 against the casing c to set the seal arrangement 650 within the casing c.

Figure 10:
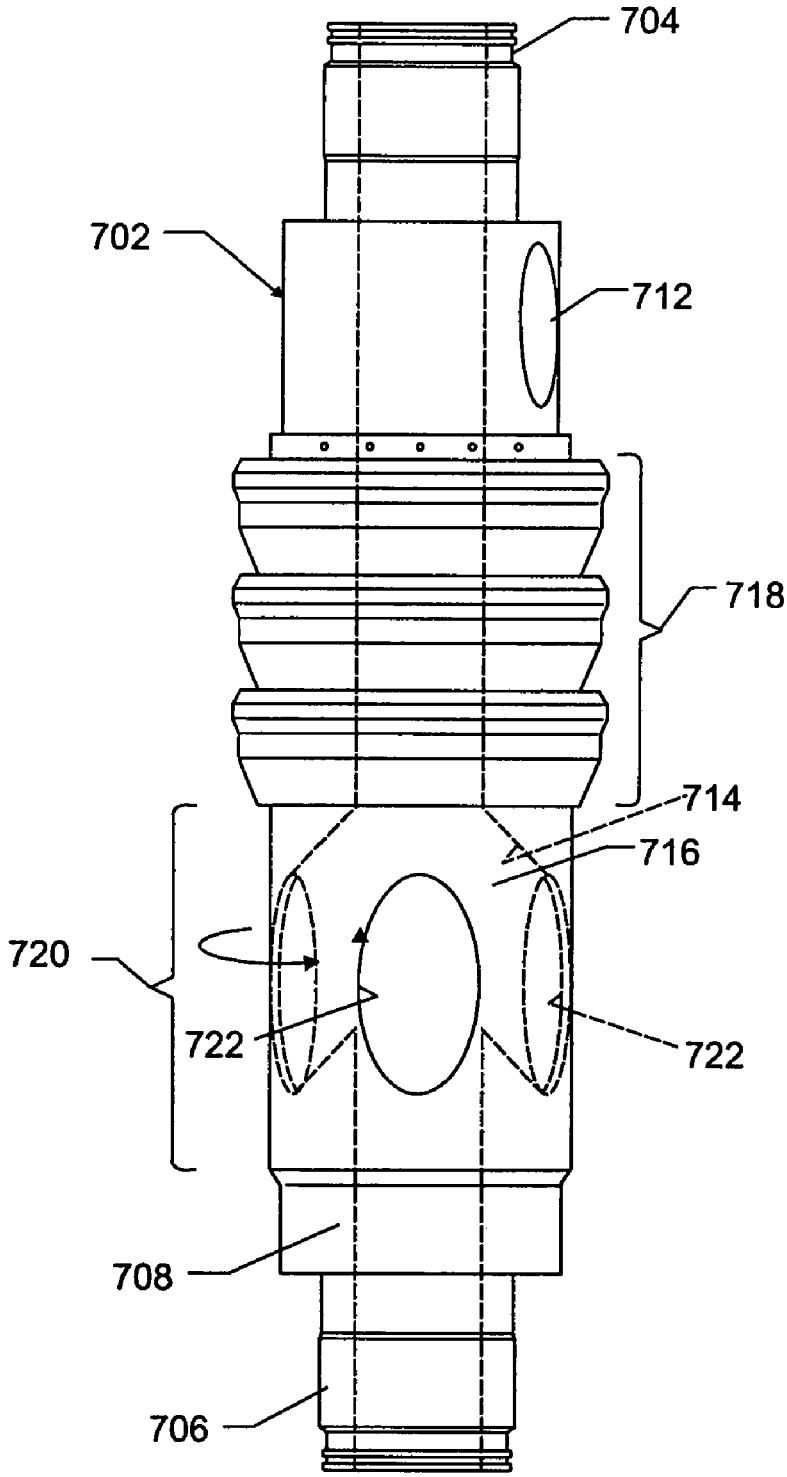
FIG. 10 is a side, external view of the annular seal assembly shown in FIG. 9.

Referring now to FIGS. 9 and 10, there is illustrated a further exemplary seal arrangement 700 that may serve as the annular seal assembly 299 for the APD device 170. This embodiment of seal assembly is useful in situations wherein the drill string is run into a wellbore and utilized without rotating the drill string. An example of such a system is the VERTITRAK® system that is available commercially from Baker Hughes Incorporated. The seal arrangement 700 includes a housing 702 with an upper axial end 704, lower axial end 706 and radially enlarged central portion 708 defined therebetween. The housing 702 defines an axial mud passage 710 therewithin. Two upper branch passages 712 extend from the axial mud passage 710 through the housing 702 to interconnect the axial passage 710 with the radial exterior of the housing 702. Two lower branch passages 714 also extend from the axial mud passage 710 through the housing 702 to interconnect the axial passage 710 with the radial exterior of the housing 702.

A sleeve 716 surrounds the majority of the length of the enlarged central portion 708 of the housing 702 and is rotatably disposed thereupon. The sleeve 716 includes a mud seal section 718 and a valve closure section 720. The mud seal section 718 includes a plurality of mud cups 668, of the type described earlier. The valve closure section 718 includes a cylindrical wall having a pair of openings 722 (one shown) therein. Rotation of the sleeve 716 causes the openings 722 to be selectively aligned and unaligned with the lower branch passages 714 of the housing 702, thereby selectively opening and closing the passages 714 to fluid flow therethrough.

Prior to running in of the seal arrangement 700, the sleeve 716 is rotated upon the housing 702 to a first position wherein the openings 722 are aligned with the lower branch passages 714 and permit fluid to enter the branch passages 714 and thereby be transmitted from the radial exterior of the housing 702 to the axial passage 710. During running in of the seal arrangement 700, the contacting portions 672 of the mud cups 668 contact the surrounding casing c and slide along it. Wellbore fluid contained within the casing c is able to bypass the seal arrangement 700 by flowing into the lower branch passages 714, axial passage 710 and then radially outwardly through the upper branch passages 712. When the seal arrangement 700 reaches the desired level within the wellbore, the drill string is rotated with respect to the casing c. Due to the engagement of the mud cups 668 with the surrounding casing c, the sleeve 716 is caused to rotate upon the outside of the central portion 708 of the housing 702, thereby closing the lower branch passages 714 to fluid flow. In order to then set the seal arrangement 700 within the wellbore, drilling mud is circulated down through the axial passage 710 by operation of the motor 200 and pump 220. As noted, previously, this decreases the fluid pressure within the annulus below the seal assembly 700 as compared to the annulus fluid pressure above the seal arrangement 700. The mud cups 668 become set against the casing c in the same manner as described previously with respect to seal arrangement 650.

Figure 11:
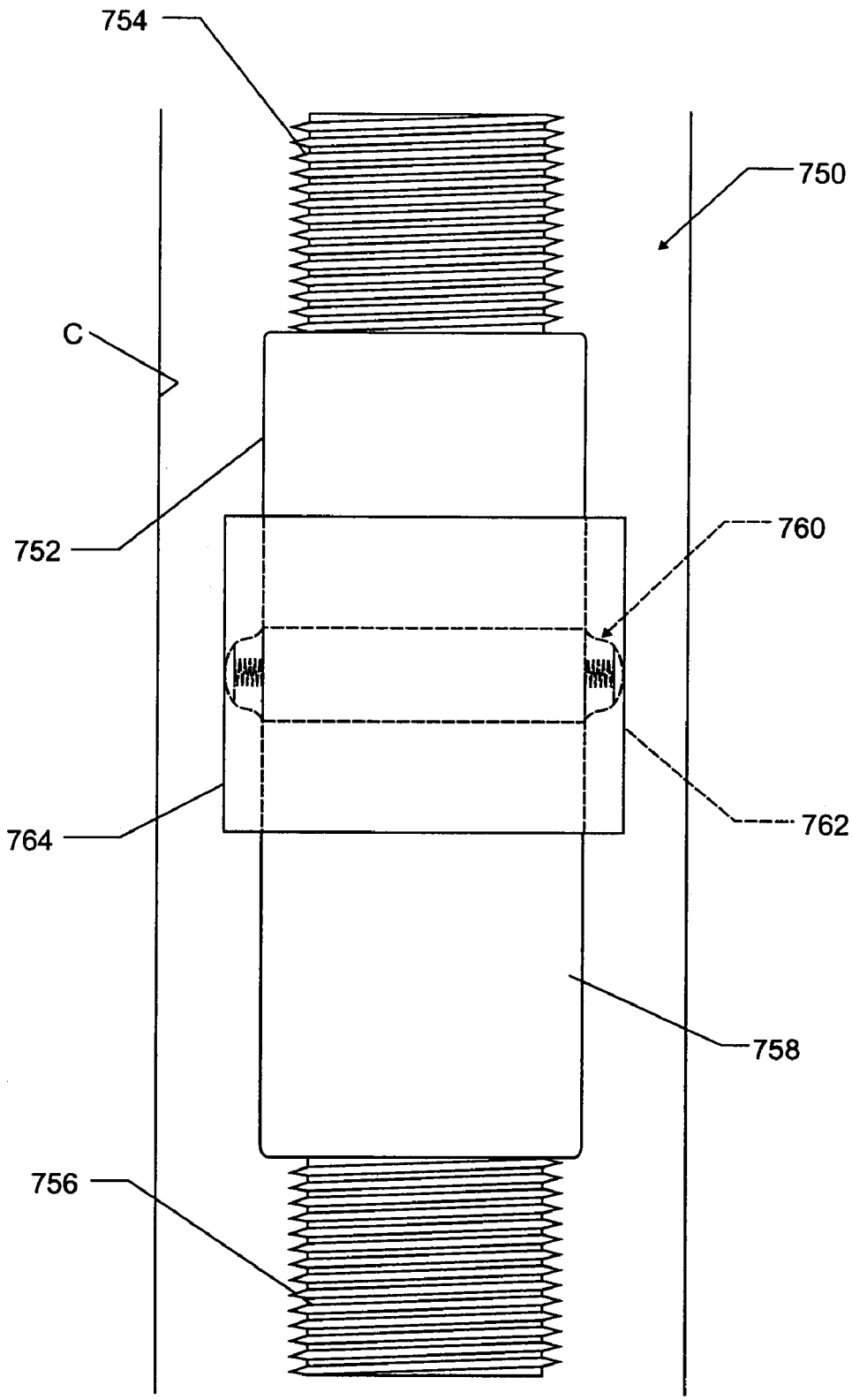
FIGS. 11 and 12 are side, cross-sectional views of a further alternative embodiment for an annular seal assembly that incorporates a sliding sleeve actuation assembly.
Figure 12:
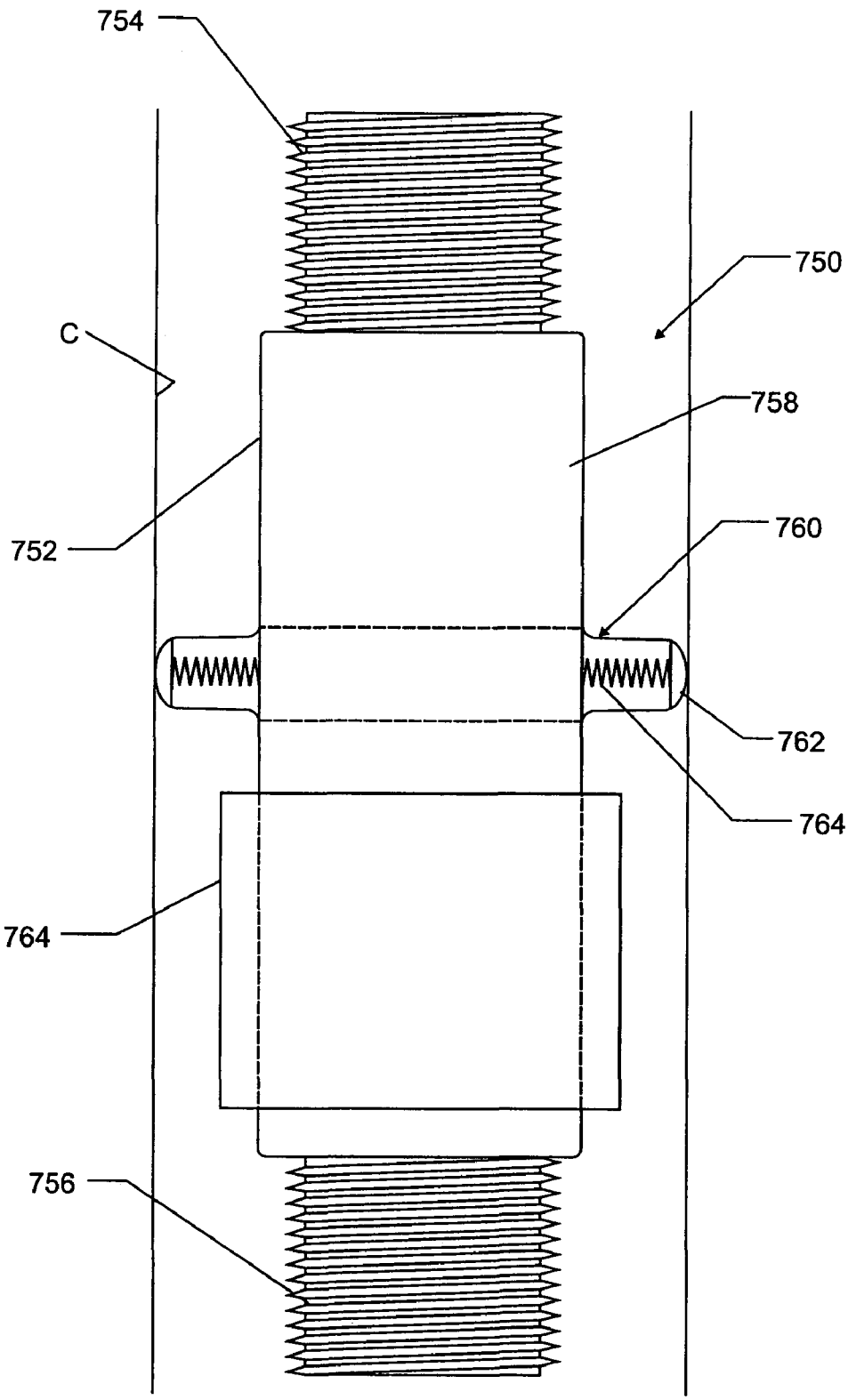

FIGS. 11 and 12 illustrate a further alternative embodiment for a seal assembly 299 which is embodied as seal arrangement 750. The seal arrangement 750 features a housing 752 with upper and lower axial ends 754, 756 and a cylindrical central portion 758. The central portion 758 carries thereupon an radially-expandable annular seal element 760. The seal element 760 is moveable between two positions: a first position (seen in FIG. 11) in which the seal element 760 is radially retracted, and a second position in which the seal element 760 is radially expanded. In a preferred embodiment, the seal element 760 includes a sealing portion 762, such as an elastomeric membrane that is capable of seating against the casing c to create a fluid seal. In addition, the seal element 760 includes a spring portion 764, which biases the sealing portion 762 toward the second, radially outward position. The spring portion 764 may comprise a mechanical spring member or series of spring members arranged circumferentially about the housing 752, or a fluid spring arrangement that is capable of biasing the sealing portion 762 radially outwardly.

The seal arrangement 750 also features a sliding sleeve actuation system for selectively actuating the seal element 760 for engagement with the casing c. An annular sleeve 764 surrounds the central portion 708 of the housing 752 and is axially slidable thereupon between two positions. In the first position, shown in FIG. 11, the sleeve 764 surrounds the seal element 760 and retains it in the retracted position. In the second position, depicted in FIG. 12, the sleeve 764 is moved axially upon the housing 752 until it not longer restrains the seal element 760 to its retracted position. The sliding sleeve 764 may be actuated for movement between its two positions through use of a wireline engagement tool, a motor actuator, or by other means known in the art.

In operation, the seal arrangement 750 is run into the wellbore with the sleeve 764 in its first position, as shown in FIG. 11, so that the seal element 760 is restrained to its radially retracted position. When the seal arrangement 750 is disposed at the depth in which it is desired to set the seal arrangement 750, the sleeve 764 is actuated to move from its first position to its second position, thereby allowing the seal element 760 to move to its second, radially expanded position and seal against the casing c. If it is desired to unseat the seal arrangement 750, the sleeve 764 is actuated to be returned to its first position, thereby again restraining the seal element 760 in its retracted position.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. An annular seal assembly for providing a fluid seal between an active pressure differential device and a wellbore sidewall, the seal assembly comprising:

a selectively inflatable seal element that is actuatable between a first position wherein the seal element is uninflated and a second position wherein the seal is inflated to provide a fluid seal during drilling; and a hydraulic inflation system for selective actuation of the seal element between its first and second positions, the hydraulic inflation system including a fluid buffer to protect the inflatable element from excessive inflation forces.

2. The annular seal assembly of claim 1 wherein the annular seal assembly is actuated by flow of drilling mud.

3. The annular seal assembly of claim 1 wherein the hydraulic inflation system comprises a hydraulic fluid chamber having an open end that is exposed to drilling mud flow, the drilling mud flow providing a fluid pressure source for inflation of the seal element to its inflated position.

4. The annular seal assembly of claim 1 wherein the fluid buffer comprises a compressible spring for absorbing excessive fluid pressures.

5. The annular seal assembly of claim 1 wherein the seal element is at least partially coated with a lubricant to facilitate movement of the seal element within a wellbore.

6. The annular seal assembly of claim 1 wherein the seal element comprises an elastomeric inflatable packer.

7. The annular seal assembly of claim 3 wherein the open end of the hydraulic fluid chamber is located on a radial exterior of said active pressure differential device to receive drilling mud that is returning to a surface of a well.

8. The annular seal assembly of claim 3 wherein the open end of the hydraulic fluid chamber is located on a radial interior of said active pressure differential device to receive drilling mud that is being pumped downward through the active pressure differential device.

9. A system for providing an active pressure differential within a wellbore, the system comprising:

an active pressure differential device having an outer housing and a fluid pump component;

an annular seal assembly for providing a fluid seal between the housing of the active pressure differential device and a wellbore sidewall, the seal assembly comprising:

a selectively inflatable seal element that is actuatable between a first position wherein the seal element is uninflated and a second position wherein the seal is inflated to provide a fluid seal; and a hydraulic inflation system for selective actuation of the seal element between its first and second positions, the hydraulic inflation system comprising a hydraulic fluid chamber having an open end that is exposed to drilling mud flow, the drilling mud flow providing a fluid pressure source for inflation of the seal element to its inflated position.

10. The system of claim 9 wherein the hydraulic inflation system further comprises a buffer for absorbing excessive inflation pressures.

11. The system of claim 9 wherein the hydraulic inflation system further comprises a pair of cylinders, each of the cylinders being in fluid communication with the seal element and each of the cylinders contains a spring.

12. The system of claim 11 wherein the cylinders are in fluid communication with each other.

13. The system of claim 9 wherein the seal element comprises an annular elastomeric packer element that is integrated into a housing of the active pressure differential device.

14. The system of claim 9 wherein the active pressure differential device comprises a pump.

15. A system for providing an active pressure differential within a wellbore, the system comprising:

an active pressure differential device having an outer housing and a fluid pump component;

an annular seal assembly for providing a fluid seal between the housing of the active pressure differential device and a wellbore sidewall, the seal assembly comprising:

a seal element that is set against the wellbore sidewall to provide a fluid seal, and a fluid passage that allows wellbore fluids to bypass the seal element as the active pressure differential device and annular seal assembly are run into the wellbore.

16. The system of claim 15 wherein the fluid passage comprises a trip valve that permits one way fluid flow.

17. The system of claim 15 wherein the seal element comprises a radially deformable mud cup.

18. The system of claim 15 wherein the seal element is set by rotation of a sleeve element to preclude fluid flow through the fluid passage.

19. A method of providing a seal between an active pressure differential device and a cased borehole wall, the method comprising the steps of:

disposing an active pressure differential device into a wellbore to a desired depth, the active pressure differential device having a fluid pump and a radially outer housing, the active pressure differential device further having an annular seal element upon the outer housing;

setting the seal element to provide a fluid seal between the active pressure differential device and the cased borehole wall.

20. The method of claim 19 wherein the seal element is inflated by flowing drilling fluid into the active pressure differential device and returning it to the surface of the wellbore.

21. The method of claim 19 further comprising the step of buffering the seal element against excessive inflation pressures.

22. The method of claim 19 wherein the step of setting the seal element further comprises receiving drilling fluid pressure into a hydraulic chamber within the housing, said drilling fluid pressure then being used to inflate the seal element.

23. The method of claim 19 wherein the step of setting the seal element comprises setting a radially deformable seal against the cased borehole wall.

24. The method of claim 19 wherein the radially deformable seal is set against the cased borehole by a pressure differential across the annular seal element.

25. The method of claim 19 wherein the step of setting the seal element comprises radially expanding a seal portion under spring bias to engage the cased borehole wall.

26. The method of claim 19 wherein the step of selling the seal element further comprises axially moving a sliding sleeve to permit the seal portion to expand radially into engagement with the cased borehole wall.

27. The method of claim 19 wherein the step of disposing the active pressure differential device into the wellbore further comprises allowing wellbore fluids to bypass the seat element as the active pressure differential device is disposed into the wellbore.

28. The method of claim 27 wherein wellbore fluids are passed through a trip valve to bypass the seal element.

* * * * *